US006868836B2

(12) United States Patent
Buehler et al.

(10) Patent No.: US 6,868,836 B2
(45) Date of Patent: Mar. 22, 2005

(54) DEVICE FOR SUPPLYING FUEL FROM A TANK TO THE INTERNAL COMBUSTION ENGINE OF A MOTOR VEHICLE

(75) Inventors: Christoph Buehler, Gerlingen (DE); Olaf Greco, Winterbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/463,512

(22) Filed: Jun. 18, 2003

(65) Prior Publication Data

US 2004/0035400 A1 Feb. 26, 2004

(30) Foreign Application Priority Data

Jun. 19, 2002 (DE) ..... 102 27 281

(51) Int. Cl.[7] ..... F02M 37/04
(52) U.S. Cl. ..... 123/509; 123/514
(58) Field of Search ..... 123/509, 514; 417/151, 198

(56) References Cited

U.S. PATENT DOCUMENTS 5,564,397 A * 10/1996 Kleppner et al. ..... 123/514
5,941,279 A * 8/1999 Frank et al. ..... 137/574
6,269,800 B1 * 8/2001 Fischerkeller et al. ..... 123/514
6,415,771 B1 * 7/2002 Mihatsch et al. ..... 123/514
6,425,378 B1 * 7/2002 Frank ..... 123/514
6,575,705 B2 * 6/2003 Akiyama et al. ..... 417/198

* cited by examiner

*Primary Examiner*—Mahmoud Gimie
(74) *Attorney, Agent, or Firm*—Ronald E. Greigg

(57) ABSTRACT

A suction jet pump for delivering fuel from a tank to the internal combustion engine of a motor vehicle is driven by fuel flowing back from the engine and delivers fuel from a tank into a collecting receptacle of a fuel delivery unit. The suction power of the pump is not limited by the propulsive jet lying against the housing wall so that the entire propulsive jet surface is no longer available for the entrainment of fuel, as in the prior art, but instead the fuel is aspirated from intake openings, which are disposed opposite each other in pairs. This permits the suction power to be noticeably increased.

8 Claims, 3 Drawing Sheets

DEVICE FOR SUPPLYING FUEL FROM A TANK TO THE INTERNAL COMBUSTION ENGINE OF A MOTOR VEHICLE

BACKGROUND OF THE INVENTION

1. Field of the Invention

The invention is directed to an improved jet pump device for supplying fuel from a tank to the internal combustion engine of a motor vehicle.

2. Description of the Prior Art

Devices similar to the invention have already been disclosed, for example by DE 198 33 130 A1, but their delivery capacities are not yet sufficient to supply enough fuel for every operating state of an internal combustion engine. DE 198 33 130 A1 discloses a suction jet pump that aspirates fuel from a tank through an intake opening. The disadvantage therein is that the aspirated fuel, due to its dynamics, deflects the propulsive jet toward the housing wall and this jet lies against the wall in the mixing tube and flows along it. As a result, the entire propulsive jet surface is no longer available for entraining fuel so that the suction power is noticeably reduced.

OBJECT AND SUMMARY OF THE INVENTION

The device according to the invention has the advantage over the prior art that the device according to the invention is improved in a simple manner by virtue of the fact that a higher delivery capacity is achieved with the same propulsive jet quantity in that the propulsive jet is prevented from lying against the housing wall. Since fuel is aspirated from openings disposed opposite each other in pairs, the forces producing the deflection of the propulsive jet partially cancel each other out so that the suction power is noticeably improved.

Advantageous improvements and updates of the device are disclosed. For example, it is advantageous to embody one of the opposing openings in the form of a slot that extends in the housing of the device over part of the circumference of the housing in the vicinity of the suction chamber since this results in a greater intake cross section.

Embodying the openings disposed opposite each other in pairs in the form of openings with circular cross sections has the advantage that the fluid level that cannot be aspirated is lower than in the embodiment with the slot.

For a high suction power of the suction jet pump, a large total area of all of the openings to the tank is advantageous, but when positioning these openings, it is necessary to bear in mind that the fluid level that cannot be aspirated in the tank increases, the higher the intake opening of the suction jet pump is disposed in relation to the bottom of the tank. To be precise, if the fluid level in the tank falls below the level of the intake opening, then no more fuel is aspirated.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
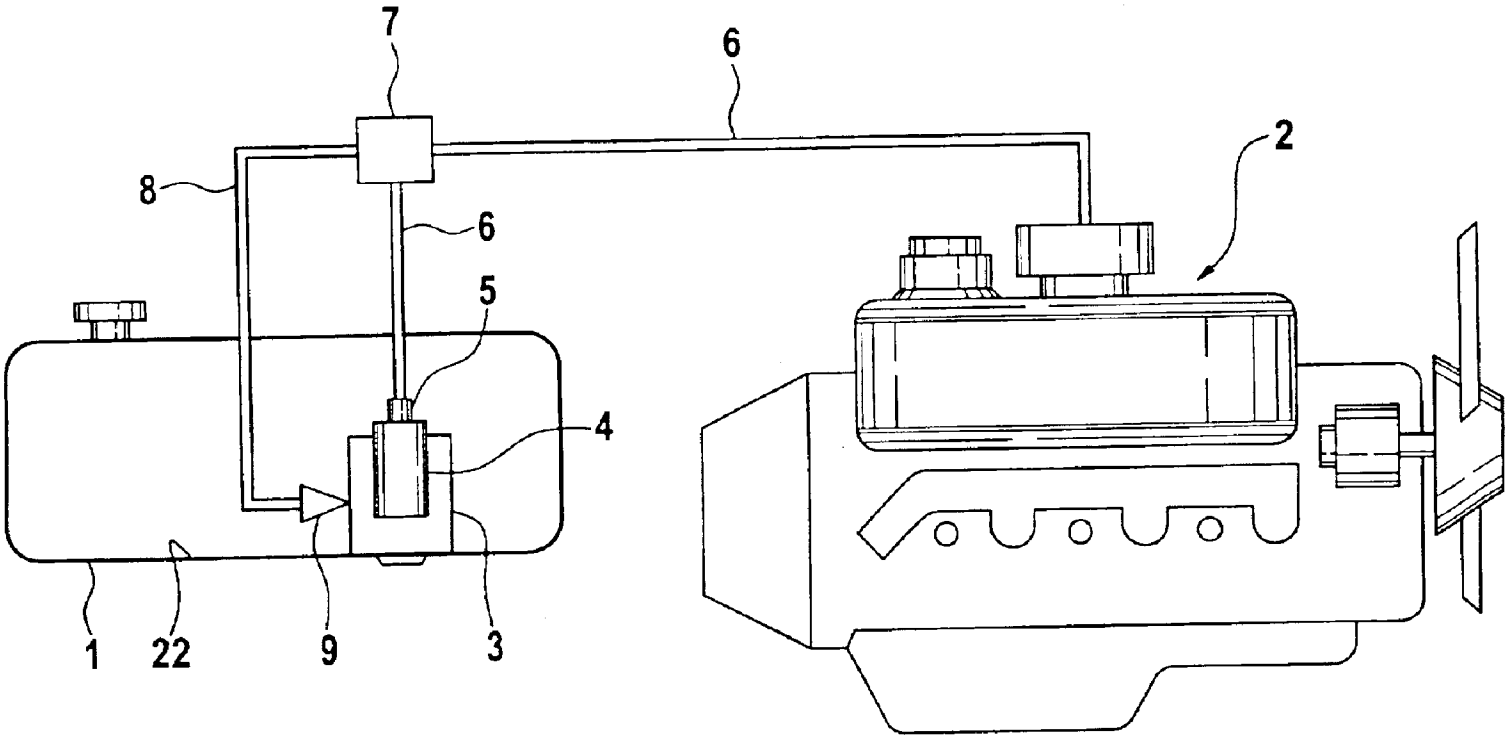
FIG. 1 shows a simplified depiction of a device for delivering fuel from a tank to the internal combustion engine of a motor vehicle.

FIG. 1 shows a simplified depiction of a device, which can be used, for example, to deliver fuel from a tank 1 to the internal combustion engine 2 of a motor vehicle. The tank 1 contains a collecting receptacle 3 from which fuel is drawn by a fuel delivery unit 4 disposed in the collecting receptacle 3. A pressure fitting 5 of the fuel delivery unit 4 is connected to a pressure line 6 that leads to the internal combustion engine 2. The pressure line 6 also contains a pressure regulator 7, which regulates the pressure of the supplied fuel in the pressure line 6 to the system pressure that has been established for the internal combustion engine 2. A return line 8 leads from the pressure regulator 7 back to the tank 1 and fuel that is not needed by the engine 2 flows back to the tank 1 through this return line. The return line 8 is connected to a suction jet pump 9 that is disposed in the tank 1 and feeds fuel into the collecting receptacle 3. During operation of the engine 2, the fuel delivery unit 4 feeds fuel from the collecting receptacle 3 to the engine 2, and the fuel flowing back through the return line 8 drives the suction jet pump 9.

Figure 2:
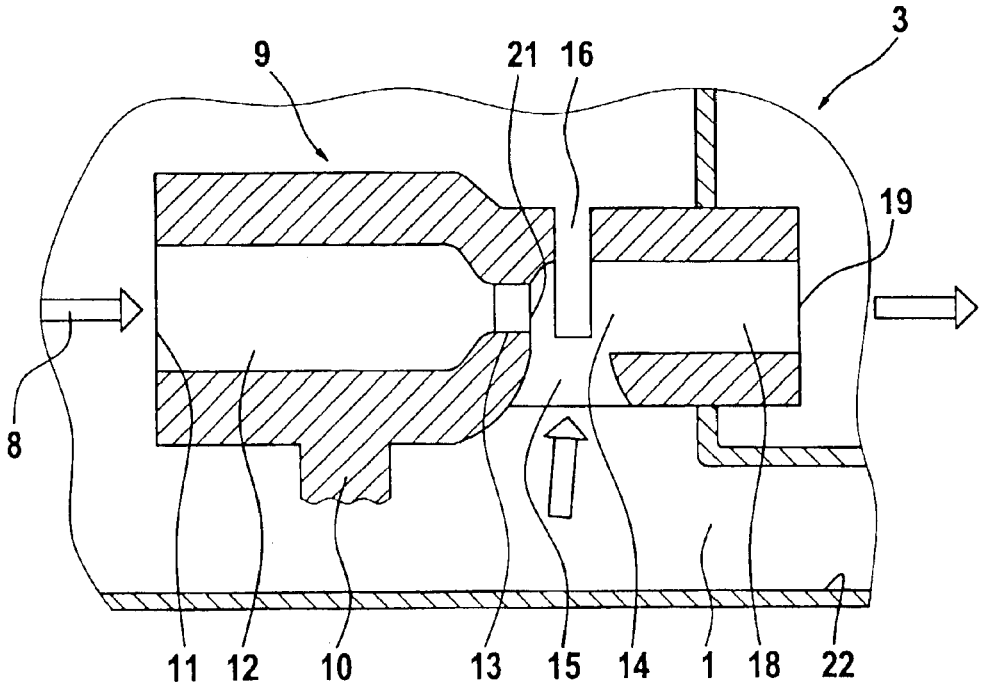
FIG. 2 shows a longitudinal section through a detail of the device from FIG. 1, with one intake opening embodied in the form of a slot.

FIG. 2 shows a simplified depiction of the suction jet pump 9 used in FIG. 1. It is comprised of a housing 10 with an inlet opening 11 to be connected to the return line 8. The fuel entering through this inlet opening 11 is conveyed through an inlet conduit 12 to a subsequent nozzle 13, the fuel travels through the nozzle outlet opening 21 into a suction chamber 14 in the form of a jet with a uniform flow direction. The jet is also referred to as a propulsive jet since it generates the vacuum that drives the suction jet pump and therefore makes it possible for an aspiration of fuel to take place. This suction chamber 14 communicates with the tank 1 by means of two openings 15 and 16, for example. The propulsive jet entrains fuel from the suction chamber 14 and a replenishing flow of fuel from the tank 1 flows into the suction chamber 14 through the intake openings 15 and 16. The intake openings 15 and 16 are disposed opposite each other; the intake opening 16 extends in the form of a slot over a part of the circumference of the housing 10 in the vicinity of the suction chamber 14. For example, the cross section of the intake opening 15 is rectangular. The propulsive jet with the aspirated fuel then travels into a mixing chamber 18 that adjoins the suction chamber 14 and leads through an outlet opening 19 into the collecting receptacle 3. The cross section of the mixing chamber 18 can widen out continuously in the flow direction in order to reduce flow noise.

Figure 3:
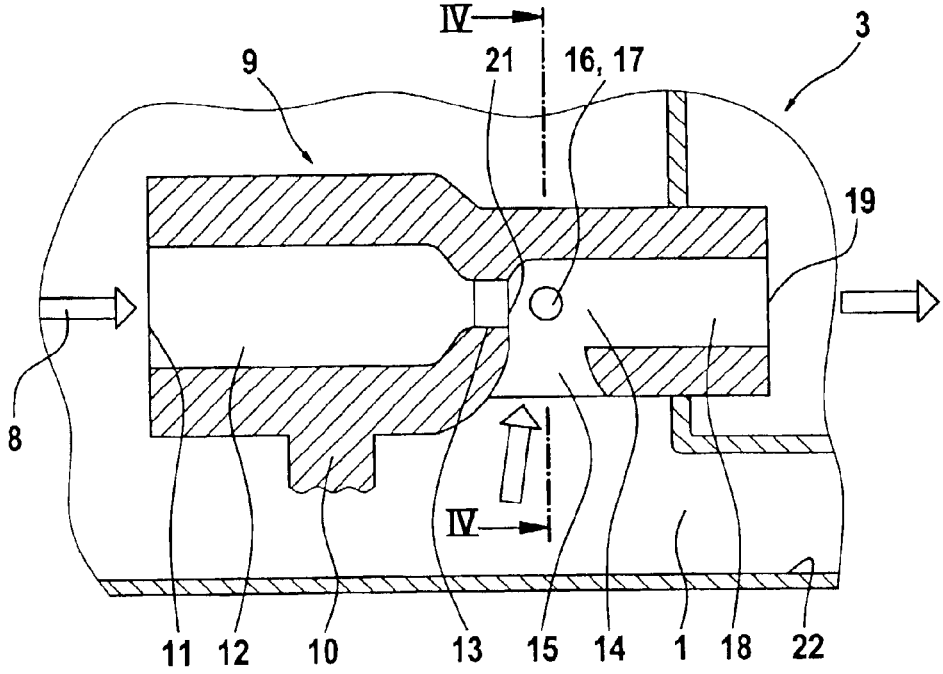
FIG. 3 shows a longitudinal section through a detail of the device from FIG. 1, with two intake openings embodied in the form of openings with circular cross sections.
Figure 4:
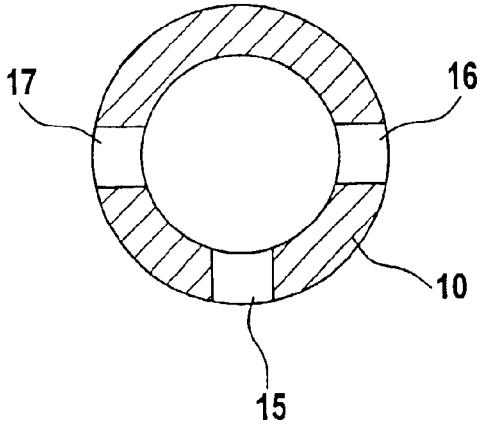
FIG. 4 shows a section along the line IV—IV in FIG. 3.

In the suction jet pump according to FIG. 3, parts that are the same or function in the same manner as those in the suction jet pump according to FIG. 2 are labeled with the same reference numerals. The suction jet pump of this embodiment differs from the suction jet pump according to FIG. 2 in that three intake openings 15, 16, and 17 are provided, the intake openings 16 and 17 being disposed opposite from each other. The cross section of the two intake openings 16 and 17 is circular, for example, but can also be oval or polygonal.

The dynamics of the aspirated fuel, which enters the suction chamber 14 not parallel to the propulsive jet direction, generate forces that deflect the propulsive jet. The fact that the intake openings 15 and 16 in FIG. 2, and 16 and 17 in FIG. 3 are disposed opposite each other causes these forces to partially cancel each other out and as a result, the propulsive jet does not lie against the housing wall. The entire propulsive jet surface can therefore be used to entrain fuel from the suction chamber 14. This permits the suction power to be noticeably improved.

The number of intake openings here is not limited to the number mentioned in the exemplary embodiments according to FIGS. 2 and 3.

When selecting the position of the intake openings, for example 15, 16, 17, it is necessary to bear in mind that the fluid level that cannot be aspirated in the tank 1 increases, the higher the intake openings, for example 15, 16, 17, of the suction jet pump 9 are disposed in relation to the bottom 22 of the tank 1. To be precise, if the fluid level in the tank 1 falls below the level of the intake openings, for example 15, 16, 17, then no more fuel is aspirated.

The foregoing relates to preferred exemplary embodiments of the invention, it being understood that other variants and embodiments thereof are possible within the spirit and scope of the invention, the latter being defined by the appended claims.

We claim:

1. A device for delivering fuel from a tank to the internal combustion engine of a motor vehicle, comprising a unitary housing with an inlet opening to be connected to a return line, the unitary housing including a restriction that is spaced apart from and downstream of this inlet opening and feeds into a suction chamber which is connected to the tank by means of at least two intake openings in the unitary housing, means providing a fuel jet traveling from this restriction into the suction chamber without being deflected, a mixing chamber that adjoins this suction chamber in the flow direction and leads through an outlet opening into a collecting receptacle, and wherein the at least two intake openings are connected to the tank and are disposed opposite each other in pairs.

2. The device according to claim 1, wherein one of the at least two intake openings disposed opposite each other is embodied in the form of a slot that extends in the housing (10) of the device over a part of the circumference of the housing (19) in the vicinity of the suction chamber (14) and produces a connection between the suction chamber (14) and the tank (1).

3. The device according to claim 1, wherein the at least two opposing intake openings (16), (17) are embodied in the form of openings with circular cross sections.

4. The device according to claim 1, comprising, in addition to the at least two intake openings that are disposed opposite each other in pairs, an additional intake opening (15).

5. A device for delivering fuel from a tank to the internal combustion engine of a motor vehicle, comprising a unitary housing with an inlet opening to be connected to a return line, the unitary housing including a restriction, a suction chamber, and a mixing chamber, wherein the restriction is spaced apart from and downstream of the inlet opening and feeds into the suction chamber, the suction chamber being connected to the tank by means of at least two intake openings in the unitary housing, means providing a fuel jet traveling from the restriction into the suction chamber without being deflected, the mixing chamber adjoining the suction chamber in the flow direction and leading through an outlet opening into a collecting receptacle, and wherein the at least two intake openings suck in from the tank and are disposed opposite each other in diametrically opposed orientation.

6. The device according to claim 5, wherein one of the at least two intake openings disposed opposite each other is embodied in the form of a slot that extends in the housing (10) of the device over a part of the circumference of the housing (19) in the vicinity of the suction chamber (14) and produces a connection between the suction chamber (14) and the tank (1).

7. The device according to claim 5, wherein the at least two opposing intake openings (16), (17) are embodied in the form of openings with circular cross sections.

8. The device according to claim 5, comprising, in addition to the at least two intake openings that are disposed opposite each other in pairs, an additional intake opening (15).

* * * * *